US011910902B2

(12) United States Patent
Godlieb et al.

(10) Patent No.: US 11,910,902 B2
(45) Date of Patent: Feb. 27, 2024

(54) DUAL MOTION CLEANSING WITH A MECHANICAL CLICK-ON ACCESSORY

(71) Applicant: KONINKLIJKE PHILIPS N.V., Eindhoven (NL)

(72) Inventors: Robert Godlieb, Drachten (NL); Sint Baron, De Knipe (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 913 days.

(21) Appl. No.: 16/957,148

(22) PCT Filed: Dec. 19, 2018

(86) PCT No.: PCT/EP2018/085748
§ 371 (c)(1),
(2) Date: Jun. 23, 2020

(87) PCT Pub. No.: WO2019/129556
PCT Pub. Date: Jul. 4, 2019

(65) Prior Publication Data

US 2020/0329841 A1 Oct. 22, 2020

(30) Foreign Application Priority Data

Dec. 28, 2017 (EP) ..... 17210784

(51) Int. Cl.
*A46B 13/02* (2006.01)
*A45D 27/04* (2006.01)
(Continued)

(52) U.S. Cl.
CPC ..... *A45D 27/04* (2013.01); *A45D 27/06* (2013.01); *A46B 13/02* (2013.01); *A47K 7/04* (2013.01); *A46B 2200/1033* (2013.01)

(58) Field of Classification Search
CPC ..... A46B 13/02; A46B 13/023; A46B 2200/1033; A47K 7/04; A45D 27/04; A45D 27/06; A61H 23/0218
See application file for complete search history.

(56) References Cited

U.S. PATENT DOCUMENTS 5,685,096 A 11/1997 Horiuchi
9,801,448 B1 * 10/2017 Jakubow ..... A46B 13/02
(Continued)

FOREIGN PATENT DOCUMENTS

CN 204260636 4/2015
DE 102013003786 9/2014
(Continued)

OTHER PUBLICATIONS

International Search Report and Written Opinion dated Feb. 28, 2019 for International Application No. PCT/EP2018/085748 Filed Dec. 19, 2018.

*Primary Examiner* — Randall E Chin

(57) ABSTRACT

The invention provides a device (1) connectable to an apparatus (1000) with a rotational driving element (1001), the device (1) comprising a connector element (58) for functional coupling to the apparatus (1000), wherein the connector element (58) is configured to be detachably attached to the apparatus (1000), a receiving element (10) for functionally coupling to the rotational driving element (1001), wherein the receiving element (10) has an axis of rotation (A), a base (20) suitable to be connected to a skin treatment element (200), a rotational coupling mechanism (30) for rotationally coupling of the base (20) with the receiving element (10), and an oscillation generator (40) configured to introduce an oscillation movement (45) to the base (20) parallel to the axis of rotation (A) during rotation of the base (20) with a base rotation frequency, based on a periodical repulsion or attraction of a first permanent magnet
(Continued)

(41) and a second permanent magnet (42) comprised by the oscillation generator (40), induced by rotation of the receiving element (10).

20 Claims, 3 Drawing Sheets

(51) Int. Cl.
*A45D 27/06* (2006.01)
*A47K 7/04* (2006.01)

(56) References Cited

U.S. PATENT DOCUMENTS

| | | | |
|---|---|---|---|
| 2013/0023901 | A1 | 1/2013 | Sanchez-Martinez |
| 2015/0202114 | A1 | 7/2015 | Pardoel |

FOREIGN PATENT DOCUMENTS

| | | |
|---|---|---|
| GB | 1541551 | 3/1979 |
| JP | S5510326 | 6/1978 |
| WO | 2014009177 | 1/2014 |

* cited by examiner

DUAL MOTION CLEANSING WITH A MECHANICAL CLICK-ON ACCESSORY

CROSS REFERENCE TO RELATED APPLICATIONS

This application is the U.S. National Phase application under 35 U.S.C. § 371 of International Application No. PCT/EP2018/085748 filed Dec. 19, 2018, published as WO 2019/129556 on Jul. 4, 2019, which claims the benefit of European Patent Application Number 17210784.9 filed Dec. 28, 2017. These applications are hereby incorporated by reference herein.

FIELD OF THE INVENTION

The invention relates to a device for use in a facial treatment, such as facial cleansing. The invention also relates to a kit of parts comprising the device and at least a facial treatment element and/or an apparatus to drive the device.

BACKGROUND OF THE INVENTION

For facial cleansing as part of a grooming routine, a mechanically powered brush may be used.

A dedicated facial treatment device for facial cleaning may have a rotating brush with an additional axial vibration ("dual motion"). This combination of simultaneous movements may provide an appreciated cleansing and oil control.

As an alternative for such dedicated facial treatment devices, also facial cleansing brushes as an accessory function with a shaver might be used. Such an accessory may be associated with a shaver by means of a mechanical interface. To function, no electrical power to the accessory is required. Moreover, just by using the mechanical power of the shaver as is provided by a rotating mechanical shaft, the facial cleansing brush functions. Such mechanical interface, however, may only transmit rotation and may not provide any axial motion. Therefore, the brush only rotates and does not axially vibrate. However, it appears that an axial vibration in addition to the rotation may add to the functionality of the brush, such as in facial cleansing.

Hence, possible solutions may comprise on the one hand dedicated facial treatment devices that may provide a good cleansing and oil control of the skin, especially based on a dual motion. On the other hand, other possible solutions may be based on simple accessories that can be connected to a mechanical device already present in almost every household, such as a shaver. However, the accessories seem to be less effective than the dedicated treatment device because they do not axially vibrate.

Skin treatment devices are known in the art. WO2014009177, for instance, describes a device for treating skin comprising a housing, a shaft located in the housing having a longitudinal axis and an end for receiving a skin treating part. The device further comprises a drive means configured to cause the shaft to rotate about its longitudinal axis, and to oscillate in a direction along the longitudinal axis, wherein the drive means comprise a rotational drive unit for rotating the shaft and an oscillation generator for oscillating the shaft. The oscillation generator is located about the shaft such that the shaft is rotatable relative to the oscillation generator. Furthermore, the oscillation generator comprises a solenoid and a flux assembly, and the flux assembly is moveable along the shaft relative to the solenoid.

SUMMARY OF THE INVENTION

Hence, it is an aspect of the invention to provide an alternative device that may be used for connecting to a skin treatment element, or (alternatively) the alternative device may include such skin treatment element, which alternative device preferably further at least partly obviates one or more of above-described drawbacks. It also is an aspect of the invention to provide a kit of parts comprising the device and a treatment element or the device and a shaver, which preferably further at least partly obviates one or more of above-described drawbacks. The present invention may have as object to overcome or ameliorate at least one of the disadvantages of the prior art, or to provide a useful alternative.

Therefore, the invention provides in a first aspect a device connectable to an apparatus with a rotational driving element, such as a shaver. The device comprises a connector element for functional coupling to the apparatus, a receiving element for functionally coupling to the rotational driving element, wherein the receiving element has an axis of rotation, a base suitable to be connected to a skin treatment element (such as a brush), a rotational coupling mechanism ("coupling mechanism") rotationally coupling of the base with the receiving element, and an oscillation generator ("oscillator") introduce an oscillation movement to the base parallel to the axis of rotation during rotation of the base, especially with a base rotation frequency, based on a periodical (mutual) repulsion or attraction of, especially a set of a first permanent magnet ("first magnet") and a second permanent magnet ("second magnet") comprised by the oscillation generator, (which periodical (mutual) repulsion or attraction is) induced by rotation of the receiving element (due to rotation of the rotational driving element, with which the base is functionally coupled). The connector element is especially configured to be detachably attached to the apparatus. In embodiments, the device may be a part of a skin treatment device. The device may especially comprise a skin treatment device.

Such device may be used as element that can functionally be coupled to an existing apparatus, such as a skin treatment apparatus, like a shaver. In an elegant way, the rotation of a rotational driving element of such apparatus, is used by the device to provide a rotating and oscillating base. The base may be (detachably) connected with the skin treatment element. Hence, with the present invention it is not necessary to use a dedicated skin treatment apparatus but one may use an existing skin treatment apparatus, which may have another function, for (detachable) attaching the device and treat the skin with the skin treatment element (detachable) attached to the base of the device. The device may comprise a skin treatment element (see below). The device, however, does not require comprising a skin treatment element (connected to the device). Yet, when used to treat (a) skin, the device especially comprises a skin treatment element. Especially, the device is connected to a skin treatment element. When being used to treat the skin, the device is further especially (detachably) coupled to an apparatus with a rotational driving element (see further below). Hence, the device is especially configured for repeatedly connecting to and disconnecting from an apparatus with a rotational driving element.

Herein, the terms "first" and "second" such as in the "first permanent magnet" and the "second permanent magnet" may be used to discriminate between two elements that are comparable or may be interchangeable. In embodiments, the terms "first permanent magnet(s)" and the "second permanent magnet(s)" may be interchangeably used.

Herein, the phrase "set of magnets" especially relates to a set or combination of a first magnet and a second magnet. Further, the term "magnet" especially relates to a "permanent magnet". Further, the term "magnet" may also refer to a plurality of magnets (especially of the same type). For instance, the term "first permanent magnet" and similar terms may refer to a plurality of first permanent magnets; likewise this may independently apply to the term "second permanent magnet".

The first permanent magnet and the second permanent magnet are arranged such that when the receiving element rotates, the magnets move relative to each other. This may imply that either the first magnet or the second magnet rotates, or that both magnets rotate.

The first permanent magnet may e.g. be arranged at (or in) the receiving element. Especially, the second permanent magnet may be arranged at or in the base. Depending on a mutual arrangement of the magnets, the magnets may repel or attract each other, especially when being located close to each other. Hence, during a movement of the magnets relative to each other, a magnetic (repelling or attracting) force may increase when the magnets approach on each other, and the magnetic force may decrease again when the magnets move away from each other.

The device is especially configured to provide a periodical mutual repulsion or attraction caused by the relative movement of the magnets. The movement of the magnets relative to each other and the resulting oscillation movement is especially induced (especially caused) by rotation of the receiving element. A rotation of the receiving element may cause the base to rotate, and especially may cause the magnets to move relative to each other providing the oscillation movement. The periodical, (mutual) repulsion or attraction of the first permanent magnet and the second permanent magnet may be provided by rotation of the receiving element. The term "oscillation movement" especially relates to a "vibrating motion" or "vibrating movement" or "vibration". Herein also the terms "axial motion" and axial movement" may relate to the term "oscillation movement".

One of the first permanent magnet and the second permanent magnet may be configured at a rotatable element of the device (i.e. rotatable relative to the remainder of the device). The other permanent magnet may be configured at a stationary element of the device, or at a further rotatable element of the device. The term "rotatable element" of the device may especially relate to the base or the receiving element. The term "stationary element" may relate to a housing of the device (see below).

Especially, one of the first permanent magnet and the second permanent magnet is comprised by the base, especially is arranged at or in the base. In an embodiment, the receiving element comprises the first permanent magnet and especially the base comprises the second permanent magnet.

Hence, the base may comprise the second permanent magnet (respectively the first permanent magnet) and especially the first permanent magnet (respectively the second permanent magnet) may be arranged for moving relative to the second permanent magnet (respectively the first permanent magnet) especially at a distance. The first permanent magnet and the second permanent magnet are preferably arranged to prevent any mutual contact during rotation of the receiving element (see also below). Especially, the first permanent magnet and the second permanent magnet move relatively to each other during rotation of the receiving element.

The first permanent magnet (respectively the second permanent magnet) may be configured to repel the second permanent magnet (respectively the first permanent magnet) when at a shortest mutual distance during a rotation of the receiving element.

The device according to the invention is a relatively simple device, especially comprising only mechanical parts (including magnetic parts). The device may be simple to produce and may be simply coupled to a standard household apparatus. The device may combine the advantages of different prior art solutions. The device requires only mechanical energy. No complex electrical system is required to provide a vibration to a skin treatment element such as a brush or a (facial) massage element. Moreover, in the device a force-actuation for the oscillation movement may be created without introducing friction, wear or excessive acoustic noise.

For the oscillation movement and the rotational movement of the base, and especially also of the skin treatment element (when present), mechanical energy may be provided by (a rotation of) a rotational (driving) element of an apparatus that is functionally coupled to the receiving element. Hence, the device is especially configured such that a rotation of the rotational element of the apparatus may provide a rotational movement and (simultaneously) an oscillation movement to a skin treatment element connected to (the base of) the device. The skin treatment element can be detachably associated with the base. Especially, the connection between the skin treatment element and the base comprises a fixed, especially play-free, connection. The connection may be configured to (substantially completely) transmit the rotational movement (of the base) and the oscillation movement of the base to the skin treatment element (see also below). The device is thus especially configured to provide a dual movement or dual motion to the base (and/or skin treatment element).

Skin treatment elements are known in the art and may e.g. comprise a (facial or skin) brush, a sponge, pumice, a massage element, etc. The skin treatment element may especially be configured for cleansing of a skin. Herein, the terms "treatment element" or "treatment head" may also relate to the term "skin treatment element".

Herein, the device may be described during operation. Especially, the term "during operation" relates to "during rotation of the receiving element". Hence, if the device is explained by the way it operates or provides changes (over time), the receiving element may rotate. Especially, the device is configured to provide different actions described herein during rotation of the receiving element.

Essentially, the receiving element of the device may be configured to match the rotational driving element of the apparatus. Especially, the receiving element and the rotational driving element may be coupled such that a rotational movement of the rotational driving element may be transmitted to the receiving element. Said two elements may in embodiments comprise a male and a respective (matching) female connector. In embodiments, the rotational driving element comprises a rotating shaft that may functionally be coupled to the receiving element. The receiving element may comprise a (complementary) shape matching the shape of the rotational driving element, such as a rotating shaft. Yet, in further embodiments, the receiving element comprises a shaft that may e.g. be arranged in a (rotating) (and matching) opening of an apparatus. Optionally, one or more additional connection elements may be applied to functionally couple the receiving element with a rotational driving element. In this way, the receiving element may be functionally coupled to different available apparatus (e.g. different types or different suppliers).

Likewise, the base may be configured to match a skin treatment element. Thus, also the base and the skin treatment element may comprise a respective male and female connector providing the connection between the treatment element and the base (and allowing a simultaneous rotation of the treatment element and the base).

The apparatus—with which the device may be functionally coupled—is essentially an apparatus or appliance comprising a rotational driving element and may e.g. comprise a shaver. Yet, also other, especially electrical, appliances may be used, such as an electric toothbrush, a nose trimmer, a hone for filing the nails, a buff for polishing nails, a beard clipper, a scalp-massage applicator, etc. Especially, the appliance comprises a click-on system that may be detached and after detaching it, the appliance reveals the rotational driving element.

Embodiments of the appliance may (also) comprise an oscillating element, oscillating when being used. Such element may comprise an oscillating drive element driving the oscillating element. Yet, such appliance may also be used if the oscillating (drive) element is functionally coupled to an axis of rotation of the appliance, and especially after detaching the oscillating element, the appliance provides a rotating part that may be functionally coupled to the receiving element. Yet, in further embodiments, a further oscillation-rotation converter may be arranged at an appliance comprising an oscillating drive element, wherein the oscillation-rotation converter comprises the axis of rotation. Hence, the apparatus may additionally comprise an oscillation-rotation converter, and especially comprising a rotational (driving) element and especially wherein the oscillation-rotation converter is configured to functionally couple the oscillating drive element to the rotational (driving) element (for converting an oscillation movement of the oscillating drive element into a rotational movement of the rotational (driving) element). The apparatus may comprise any appliance described above. Advantageously, the apparatus is a commonly used apparatus in a household. In this way, e.g. different types of shavers could be used as apparatus to which the device can be coupled, such as shavers based on a rotating shaving head or a shaver based on a pivoting shaving head.

The connector element is especially an element that allows the device to be associated with the apparatus. Especially, the connector element is configured to provide a detachable fixation with the apparatus. The connector element may be configured to provide a click-on fixation with the apparatus. Hence, herein the device may also be referred to as a mechanical click-on accessory. The connector element may thus provide a (mechanical) fixed (or stationary) (but detachable) connection between the device and the apparatus; the receiving element is used for the transfer of rotational energy of the rotational driving element of the apparatus to the receiving element of the device.

The device may comprise a housing, wherein the housing comprises a first inner wall at a first side of the housing and a second inner wall at a second side of the housing. Especially, the second side of the housing is arranged opposite to the first side of the housing, and may define a space between the first side and the second side for containing the base. The housing may enclose the rotational coupling mechanism and the oscillation generator and at least part of the base and at least part of the receiving element. The housing may be configured to allow the base to rotate in the housing and (to allow the base) to oscillate in the housing between the first inner wall and the second inner wall. The housing may comprise the connector element.

In an embodiment, the housing comprises the first permanent magnet, especially wherein the base comprises the second permanent magnet. The first inner wall may, e.g., comprise the first permanent magnet. Alternatively or additionally, the second inner wall may comprise the first permanent magnet. Yet, as indicated above, the first permanent magnet and the second permanent magnet may be mutually changed around. The (first and/or second) permanent magnet may be configured for comprising a magnetic axis of the respective permanent magnet parallel to the axis of rotation.

Herein, the terms "first permanent magnet" may relate to more than one (different) first permanent magnets. Likewise, the terms "second permanent magnet" may relate to more than one (different) permanent magnet. Such respective permanent magnets are especially substantially identical magnets. Yet, one or more of such respective permanent magnets may be arranged differently, and as such provide a different, such as opposite magnetic field between a (plurality of) first permanent magnet(s) and a (plurality of) second permanent magnet(s).

Especially, the term "magnet" herein relates to a combination of (north and south) magnetic poles. The magnet, not necessarily comprises an individual piece or monoblock of magnetized material. In an embodiment, the device, especially one or more of the first and the second permanent magnet, may, e.g., comprise a ring or disk magnet comprising multiple poles. A device described herein "comprising a plurality of first magnets and/or a plurality of second magnets" may actually comprise (only) one or two disk magnets comprising multiple poles (and therefore comprising a plurality of magnets). Essentially, such embodiment may function the same as an embodiment comprising multiple discrete magnets (wherein each discrete magnet may comprise only one north pole and one south pole).

Especially, the device comprises more than one of the first and/or the second permanent magnet. In an embodiment, either one of the (only one) first permanent magnet or the (only one) second permanent magnet is comprised by the base, whereas the other magnet is arranged at a location that does not move relative to the connector element, especially the housing, during a rotation of the base. In such embodiment an oscillation frequency of the base may be equal to a base rotation frequency, during a (one) rotation of the base. Especially, the magnets may mutually repel or attract each other once during a rotation of the base. By adding a further first or second permanent magnet, a number of repulsions or attractions per rotation of the base may be doubled.

Hence, in an embodiment the device comprises one or more of a plurality of first permanent magnets and a plurality of second permanent magnets for providing an oscillation frequency of the base higher than a base rotation frequency during the rotation of the base.

It may further be advantageous that the oscillating frequency comprises a constant (non-fluctuating) oscillation frequency. During a rotation of the base, a repulsion and/or attraction may be provided in standard intervals. For providing a constant frequency of oscillation, more than one first permanent magnet, respectively more than one second permanent magnet, (if present) are especially arranged (rotationally) symmetric around the axis of rotation.

In embodiments, more than one first magnet and/or more than one second magnet may be distributed differently, especially not rotationally symmetric, around the axis of rotation for providing a repeating pattern of oscillation, especially comprising an oscillation frequency pattern (repeating during rotation of the receiving element).

Especially, (a first end of) one or more first permanent magnets are arranged at an edge of a first circular plane configured (axial) symmetric around the axis of rotation, wherein (a second end of) one or more second permanent magnets are arranged at an edge of a second circular plane and configured (axial) symmetric around the axis of rotation and especially wherein the more first permanent magnets (if present) and/or the more second permanent magnets (if present) are arranged rotationally symmetric around the axis of rotation. Further, especially a longitudinal axis of the first permanent magnet comprises the edge of the first circular plane. Likewise, a longitudinal axis of the second permanent magnet comprises the edge of the second circular plane. In such configuration, periodically a first end of a first permanent magnet may face a second end of a second permanent magnet during rotation of the receiving element. A longitudinal axis of a magnet may comprise the magnetic axis of said magnet.

The first circular plane and the second circular plane especially do not coincide. The first plane and the second plane may be configured at a mutual (minimum) distance selected from the range of 0.05 mm-5 mm, such as 0.5 mm-2 mm, especially 0.1-1 mm (during no rotation of the receiving element). As such, a minimum distance between the first end of a first permanent magnet and a second end of a second permanent magnet may be selected from the range of 0.05 mm-5 mm, such as 0.5 mm-2 mm, especially 0.1-1 mm. The first end of the first permanent magnet may face a second end of a second permanent magnet when at a shortest mutual distance during a rotation of the receiving element, especially wherein the shortest mutual distance is selected from the range of 0.05 min-5 mm, such as 0.05 mm-2 mm, especially 0.1-1 mm, such as 0.2-0.8 mm, especially 0.3-0.6 mm. The distance between the first plane and the second plane may periodically change during rotation of the receiving element (especially providing the oscillation movement of the base). The first circular plane and/or the second circular plane may be configured comprising a physical element of the device, such as the first wall, or the second wall, or the receiving element. Said planes may also be configured not to comprise such element. Hence, the first permanent magnet(s) and/or the second permanent magnet (s) may be incorporated in (such) a physical element of the element. The second permanent magnet(s) may e.g. be completely contained in the base. The first permanent magnet(s) may be completely contained in the receiving element. Yet, in a further embodiment, the first permanent magnets are configured at (a surface of) the base. In a further embodiment, the first permanent magnet(s) are partly incorporated in the base.

Hence, a shortest distance between magnets of a set of magnets during rotation may be selected from the range of 0.05 mm-5 mm, such as 0.5 mm-2 mm, especially 0.1-1 mm.

The first permanent magnet and the second permanent magnet are especially configured to periodically allow the magnetic axis of the first permanent magnet to substantially coincide with the magnetic axis of the second permanent magnet during rotating of the receiving element. In an embodiment, a ratio of the first (minimal) distance between the edge of the first circular plane and the axis of rotation and a second (minimal) distance between the edges of the second circular plane is selected from the range of 0.75-1.25, such as in the range of 0.9-1.1, especially in the range of 0.95-1.05.

Hence, in an embodiment, one or more first permanent magnets are arranged at a first circular plane having a first distance to the axis of rotation, and one or more second permanent magnets are arranged at a second circular plane having a second distance to the axis of rotation, especially wherein a ratio of the first distance to the second distance is selected from the range of 0.75-1.25, such as 0.9-1.1, especially wherein the first distance and the second distance are substantially equal. The ratio may substantially be equal to 1.0. A direction of the force between the first permanent magnet and the second permanent (when at a shortest mutual distance during a rotation of the receiving element) may be defined by a first component (of the force) in a direction parallel to the magnetic axis of the first (or respectively second) permanent magnet and a second component (of the force) in a direction perpendicular to the first component (and arranged in the plane comprising the direction of the force and the first component). Especially, the first permanent magnet and the second permanent magnet are arranged such that the first component is larger than zero, and especially larger than the second component (of the force). Especially, the first permanent magnet and the second permanent magnet are arranged for providing a mutual impact in a direction parallel to the axis of rotation (when at a shortest mutual distance during a rotation of the receiving element).

Further embodiments may comprise a total number of first permanent magnets and a total number of second permanent magnets. In embodiments a ratio of the total number of first permanent magnets to the total number of second permanent magnets or a ratio of the total number of second permanent magnets to the total number of first permanent magnets is an integer. The device may e.g. comprise two first permanent magnets and two, four, six, eight, etc. second permanent magnets. The device may also comprise three second permanent magnets and e.g. three, six, nine, etc. first permanent magnets. Especially, the total number of first permanent magnets equals the total number of second permanent magnets. The total number of first permanent magnets may at least be two.

It may further be advantageous to arrange the magnets close to the axis of rotation. By configuring the magnets close to the axis of rotation, the device may be stiffer than a device wherein the magnets are configured at al larger distance to the axis of rotation. A width of the device may be defined by a largest distance from a first side of the device to a second side of the device along a line perpendicular to the axis of rotation. In embodiments a ratio of the first distance and/or the second distance (the respective distances described above related to the distance between the first or respective second permanent magnet and the axis of rotation) to the width of the device is equal to or smaller than 0.5, especially equal to or smaller than 0.25, even more especially equal to or less than 0.1. Said ratio is especially larger than zero. Hence, in embodiments a ratio of de first distance to the width is selected from the range of larger than 0 and smaller than or equal to 0.25. Especially, also the ratio of the second distance to the width of the device is selected from the range of larger than 0 and smaller than or equal to 0.25.

Especially, a compact arrangement with opposing sets of first permanent magnets and second permanent magnets close to the axis of rotation allows for an actuation, especially an oscillating movement, at the point the motion is required. This may reduce the need for stiffness and tight tolerances in the build-up of the device and/or treatment element. For instance, the distance to the axis may be equal to or less than 1.5 cm, such as in the range of 1-12 mm.

The rotational coupling mechanism may be a transmission system. The coupling mechanism may transmit a rotational movement of the receiving system to the base. The coupling mechanism may further provide a rotational movement with a base rotation frequency to the base, based on a receiving element rotation frequency of the receiving element. In embodiments, the base rotation frequency and the receiving element frequency are the same. Especially, the base rotation frequency (provided by the coupling mechanism to the base) differs from the receiving element rotation frequency. The base rotation frequency may be larger than the receiving element rotation frequency. In embodiments, (also) the direction of the rotational movement of the base and the direction of the rotational movement of the receiving element are not the same.

Hence, in an embodiment the rotational coupling mechanism is configured to provide a rotational movement of the base in an opposite direction to a rotational movement of the receiving element.

The coupling mechanism may comprise a gear system to transmit the rotational movement of the receiving element to the base. Especially, the receiving element comprises (or is rigidly connected) to a first gear. In a further embodiment, the base comprises (or is rigidly connected to) a second gear. The first and the second gear may be functionally coupled, especially the first and the second gear may comprise teeth and mutually mesh (during rotation). The first and the second gear may also be part of a gear train comprising (or defined by) more than two gears, especially (together) configured to all work in sequence.

Hence, in an embodiment, the rotational coupling mechanism comprises a first gear and a second gear, wherein the receiving element comprises the first gear and wherein the base comprises the second gear, and wherein the first gear and the second gear are rotationally coupled, optionally via one or more further gears, especially wherein the rotational coupling mechanism is configured to provide a base rotation frequency to the base based on a receiving element rotation frequency of the receiving element during rotation of the receiving element.

Hence, the term "rotationally coupling" and the like, such as in the phrase a rotationally coupling mechanism for rotationally counting of the base with the receiving element especially refers to a mechanism wherein a rotation of a first element (such as the receiving element) causes a rotation of a further element (such as the base) and/or vice versa. The gear train may be configured to provide a rotation speed (rotation frequency) and/or a rotational direction to the base that differs from the rotation speed (rotation frequency) and/or direction of the receiving element. In embodiments, the first gear, the second gear, and the optional one or more further gears are configured to provide a ratio of the base rotation frequency to the receiving element rotation frequency selected from the range a 0.2-5, during rotation of the receiving element.

The rotational coupling mechanism is further configured to allow an oscillation movement of parts of the rotational coupling mechanism relative to each other. For instance, the gears may keep functioning when they translate relative to each other in a direction of the axis of rotation (during oscillation of the base).

The device of the invention may comprise different degrees of freedom in the configuration of the device for providing the frequency of oscillation. The frequency of oscillation may be dependent on the number of first and/or second permanent magnets. The frequency of oscillation may further be dependent on the rotation frequency and rotation direction of the base in relation to the rotation frequency and the rotation direction of the receiving element.

In an embodiment, the oscillation generator is configured to provide a ratio of a frequency of the oscillation movement (of the base) to a rotation frequency of the receiving element selected from the range of 1-250, especially in the range of 4-96, such as in the range of 5-50 (during rotation of the receiving element). In a further embodiment, said ratio is selected from the range of 0.1-1, especially 0.3-1.

Typically, the rotation frequency of the receiving element may be at least 500 rpm (about 8 Hz.), such as in the range of 500-10000 (about 8-160 Hz.), especially 2000-6000 rpm (30-100 Hz.). Yet, in embodiments of the apparatus, such as in a massage applicator, the rotation frequency of the receiving element may be in the range 200 or 400 rpm. Especially, the rotational coupling mechanism is configured to provide a rotation frequency to the base selected in the range of 50-500 rpm (about 1-10 Hz.), especially in the range of 100-400 rpm (2-7 Hz.), such as in the range of 150-300 rpm (2.5-5 Hz.). In an embodiment, the rotational coupling mechanism is configured to provide a rotation frequency to the base of 200±25 rpm (about 3.3 Hz.). In embodiments, the oscillation generator is configured to provide an oscillation frequency equal to or larger than 5 Hz., such as equal to or larger than 10 Hz., especially equal to or larger than 100 Hz., and especially equal to or smaller than 250 Hz., such as equal to and smaller than 150 Hz. In an embodiment, the oscillation generator is configured to provide a ratio of a frequency of the oscillation movement (of the base) to a base rotation frequency selected from the range of 1-100, especially in the range of 3-50, such as in the range of 3-33 (during rotation of the receiving element). In a further embodiment, said ratio is selected from the range of 0.1-1, especially 0.3-1.

Hence, in specific embodiments the apparatus and the device are chosen such, that a rotation frequency to the base of 200±25 rpm (about 3.3 Hz.) can be provided.

The skin treatment element, when available, is functionally coupled to the base, and will thus rotate with the same rotation frequency as the base. Likewise, the oscillation of the skin treatment element is thus the same as of the base.

During use of the device using a treatment element, the treatment element may be pressed to a skin of the user. Therefore, the device may be configured to especially provide a part of the oscillation movement, wherein the base moves away from the connector element, especially based on a mutual repulsion of one or more first permanent magnets and one or more second permanent magnets. A remaining part of the oscillation movement, wherein the base moves in a direction towards the connector element, may be provided by an attraction force of one or more first permanent magnets and or more second permanent magnets. The remaining part of the oscillation may also be provided by a reaction force based on pressing the treatment element to the skin of the user. The remaining part of the oscillation may further be provided by some further elements of the device forcing the base in the direction of the connector element. Such further elements may comprise a resilient element. The resilient may e.g. comprise a spring. The resilient element in combination with the base and optionally the treatment element may define a spring-mass system. Such spring-mass system advantageously may comprise a natural frequency. During rotation of the base, the base may oscillate caused by the first permanent magnet and the second permanent magnet. The base may comprise a play and may oscillate (because of the magnets) in the play. When forcing the base in the direction of the connector element with the resilient element or spring, it may become possible to oscillate at the natural frequency of the mass-spring system of the base+resilient element+the optional treatment element. This may provide an increased amplitude (relative to a device not comprising the resilient element).

Hence, in a further embodiment, the device comprises a resilient element configured to force the base in a direction of the connector element. Especially, the device further comprises a resilient element arranged between the housing and the base and configured to resiliently translate the base in a direction to the first inner wall.

The device may be configured such that the base may rotate relative to the receiving element. In an embodiment, the device is configured for rotating the base around the receiving element. The device may e.g. comprise a bearing, especially functionally coupled to the receiving element and functionally coupled to the base, and configured to allow a rotational movement of the base around the receiving element. Yet, the device may also be configured to allow a rotation of the base at the receiving element.

In an embodiment, the receiving element comprises a protrusion protruding at a first end of the receiving element in a direction of the axis of rotation and configured rotationally symmetric around the axis of rotation, especially wherein a coupling element is arranged at a second end of the receiving element and configured to functionally couple to the rotational driving element of the apparatus. Further, the base may comprise a first base end configured to connect to the skin treatment element (or connected to the skin treatment element) and a second base end comprising a second base end opening configured rotationally symmetric around the axis of rotation and encompassing the protrusion, especially wherein the second base end opening is configured to allow the base to rotate about the protrusion and to oscillate parallel to the axis of rotation relative to receiving element.

The device may especially comprise the skin treatment element. Especially, the invention provides a device as described herein, for treating, especially cleansing, a skin, wherein the device comprises the skin treatment element connected to the base. Such (embodiment of the) device is configured for rotating the skin treatment element, especially at a skin treatment element rotation frequency, relative to the connector element, and (for) simultaneously oscillation of the skin treatment element, especially at a skin treatment oscillation frequency, relative to the connector element, (during rotation of the receiving element). The skin treatment rotation frequency and the oscillating frequency of the skin treatment element are (also) especially based on the rotation frequency of the receiving element. Especially, the skin treatment rotation frequency and the base rotation frequency are equal. Furthermore, (also) the oscillation frequency of the skin treatment head may equal the oscillation frequency of the base. The device may be a device for dual motion cleansing.

In further embodiments, the device for treating a skin is configured to provide a ratio of the oscillation frequency to the rotation frequency of the receiving element equal to or larger than 3, especially equal to or larger than 5, such as equal to or larger than 12, and especially equal to or smaller than 96, such as equal to or smaller than 50.

The device may further comprise a shaver connected to the device, wherein the connector element is functionally coupled to the shaver and wherein the shaver comprises a rotational driving element functionally coupled to the receiving element, especially for providing a rotation to the receiving element.

In a further aspect, the invention provides a kit of parts comprising a device as described herein and one or more skin treatment elements functionally connectable to the base of the device described herein Yet, in a further aspect, the invention provides a device described herein (without a shaver), and a shaver. Especially, the shaver comprises a rotational driving element. The device may (essentially) be functionally connectable to the rotational driving element of the shaver.

Especially, advantageous embodiments of the device comprise options as described above.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1:
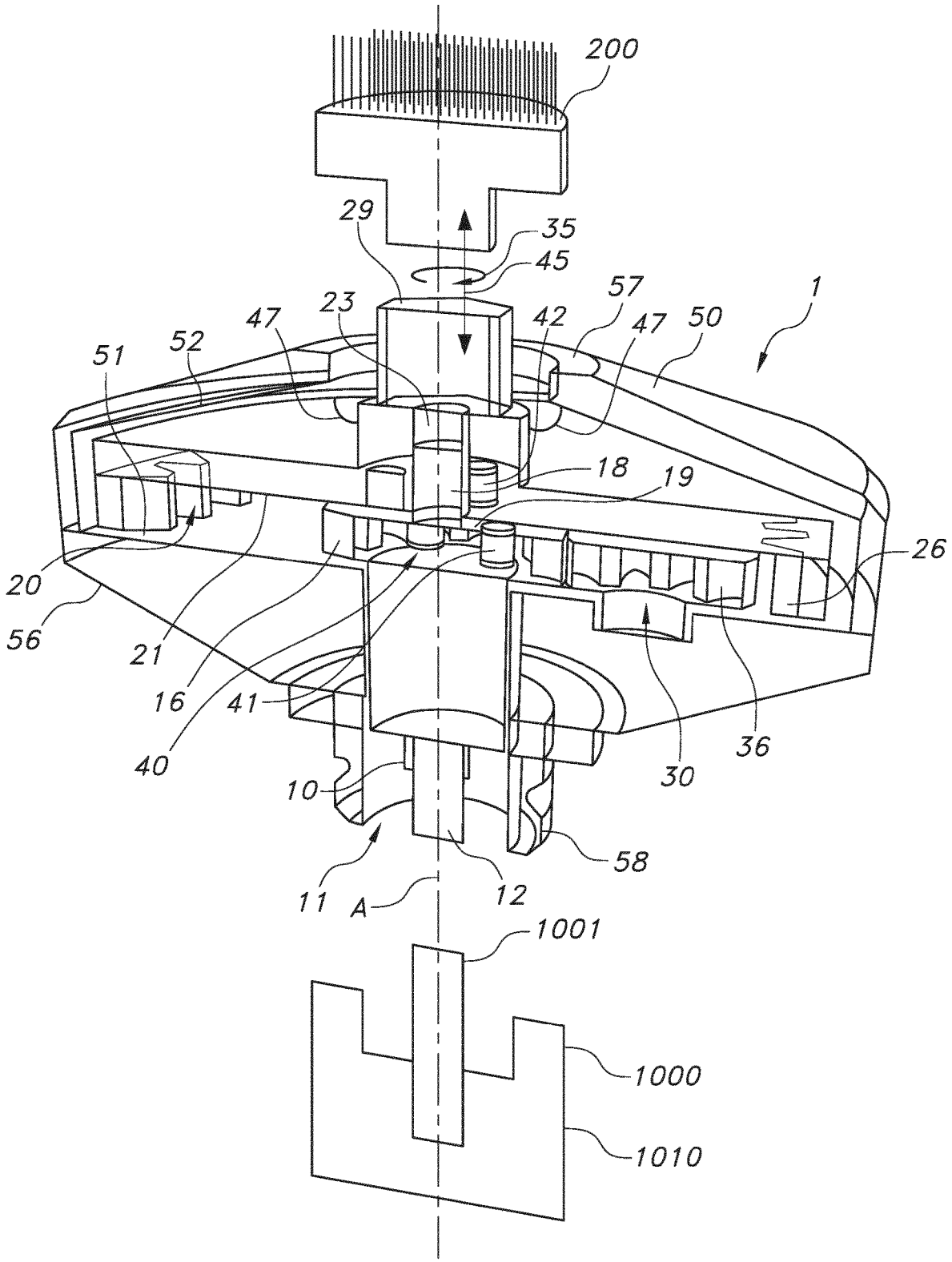
FIG. 1 schematically depicts an embodiment of a device according to the invention.

FIG. 1 schematically depicts an embodiment of a device 1. The device 1 is connectable to an apparatus 1000 with a rotational driving element 1001, very schematically depicted below the device 1. The apparatus 1000, such as a shaver 1010, may be coupled to a connector element 58 for functional coupling to the apparatus 1000, comprised by device 1. The connector element 58 is especially configured to be detachably attached to the apparatus 1000, especially thereby providing a connection wherein the connector element 58 may not move relative to the apparatus 1000 (also if the rotational driving element 1001 rotates). The device 1 comprises a receiving element 10 for functionally coupling to the rotational driving element 1001 of the apparatus 1000. The receiving element 10 has an axis of rotation A. The receiving element 10 is rotatable and may rotate based on rotation of the rotational driving element 1001 (when coupled). The device further comprises a base 20 suitable to be connected to a skin treatment element 200, as is also schematically depicted by the skin treatment element 200 pictured on top of the device 1.

The device 1 is especially configured to provide simultaneously a rotational movement 35 and an oscillation movement 45 (vibration 45) to the base 20 (and successively to the treatment head 200 (when attached to the device 1)) based on a rotation of the receiving element 10 (and especially a rotation of the rotational driving element 1001). Especially, for providing these simultaneous movements 35, 45 to the treatment element 200, the device 1 comprises a rotational coupling mechanism 30 and an oscillation generator 40. The rotational coupling mechanism 30 is configured for rotationally coupling of the base 20 with the receiving element 10. The oscillation generator 40 comprises a first permanent magnet 41 and a second permanent magnet 42. The oscillation generator 40 is especially configured to introduce an oscillation movement 45 to the base 20 parallel to the axis of rotation A during rotation of the base 20. The oscillation movement 45 is based on a periodical repulsion or attraction of the first permanent magnet 41 and the second permanent magnet 42, especially induced by (as a function of) rotation of the receiving element 10.

It is noted that the first end 19 of the receiving element 10 is partly given in exploded view demonstrating the first permanent magnets 41 which are in this embodiment actually incorporated in the first end 19 of the receiving element 10 and also showing the first gear 10 as seen from the axis of rotation A. Also a part of the base has been pictured in exploded view to indicate the second permanent magnet 42, which is in this embodiment actually comprised in the base 20.

Figure 4:
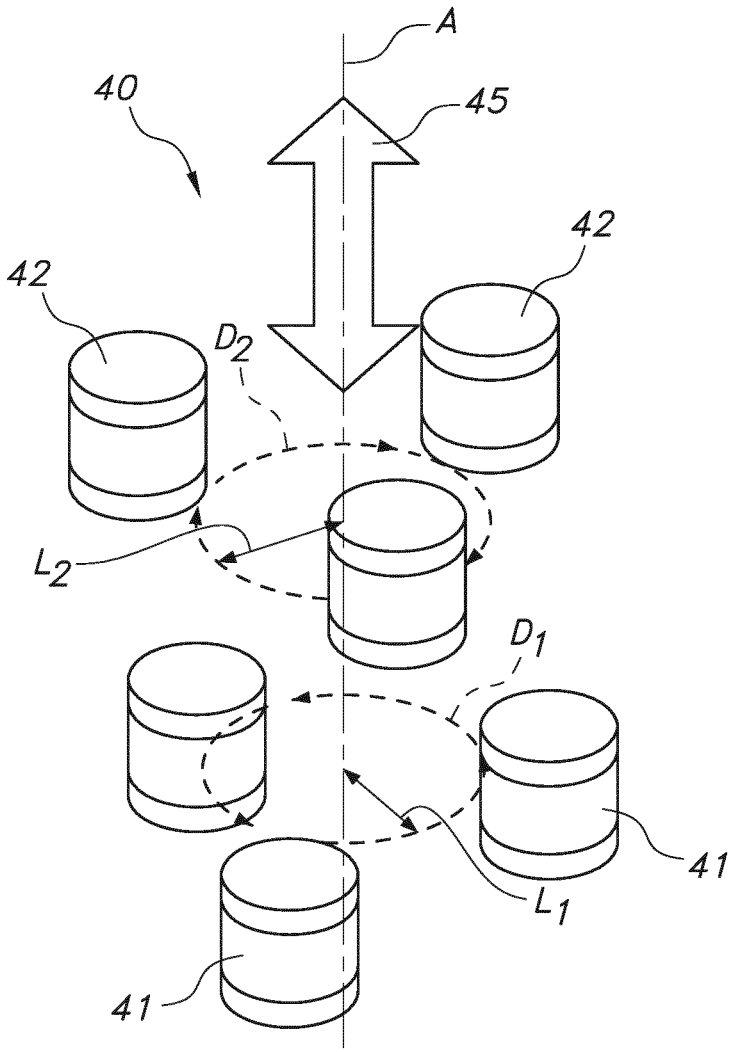
Figure 5:
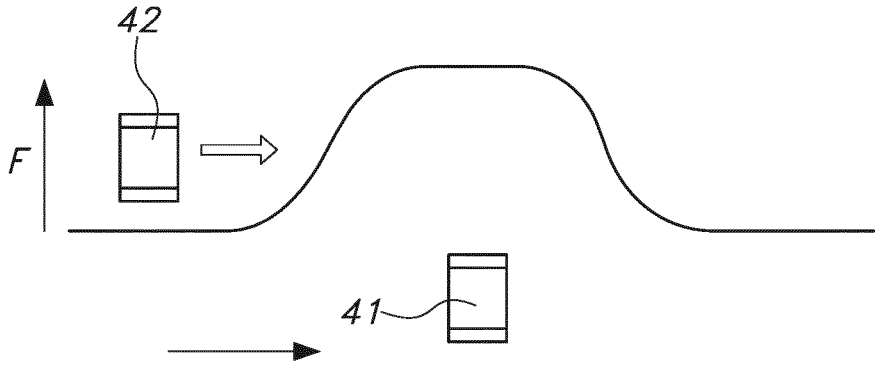

Especially, the repulsion or attraction is provided when the first permanent magnet 41 and the second permanent magnet 42 are positioned at a mutual shortest distance that is provided during a rotation of the receiving element 10 (see also FIGS. 4 and 5). In embodiments, the first permanent magnet 41 is configured to repel the second permanent magnet 42 when at a shortest mutual distance during a rotation of the receiving element 10.

The embodiment depicted in FIG. 1 further comprises a housing 50 comprising a first inner wall 51 at a first side 56 of the housing 50 and a second inner wall 52 at a second side 57 of the housing 50. As such, the housing 50 encloses the rotational coupling mechanism 30 and the oscillation generator 40 and further almost the entire base 20 and almost the entire receiving element 10. The housing 50 is especially configured to allow the base 20 to rotate in the housing 50 and to allow the base to oscillate in the housing 50 between. the first inner wall 51 and the second inner wall 52.

The device 1 may comprise one or more of a plurality of first permanent magnets 41 and a plurality of second permanent magnets 42 for providing an oscillation frequency of the base 20 higher than a base rotation frequency during the rotation of the base 20. In the depicted embodiment, the receiving element 10 comprises the (especially three) first permanent magnet(s) 41, and the base 20 comprises the (especially three) second permanent magnet(s) 42.

In the embodiment, all of the first permanent magnets 41 are arranged at a first circular plane D1 having a first distance L1 to the axis of rotation A, and all second permanent magnets 42 are arranged at a second circular plane D2 having a second distance L2 to the axis of rotation A, see e.g. FIG. 4 depicting these circular planes D1, D2. Especially, the first magnet(s) 41 are arranged at the first circular plane D1 such that a minimal distance between the axis of rotation A and the first magnet equals the first distance L1. Likewise, the second magnet(s) 42 are arranged at the second circular plane D2 especially such that a minimum distance between the second magnet(s) 42 and the axis of rotation A equals L2. In preferred embodiments, a ratio of the first distance L1 to the second distance L2 is selected from the range of 0.9-1.1. In the given embodiment, the first distance L1 and the second distance L2 are substantially the same.

Figure 3:
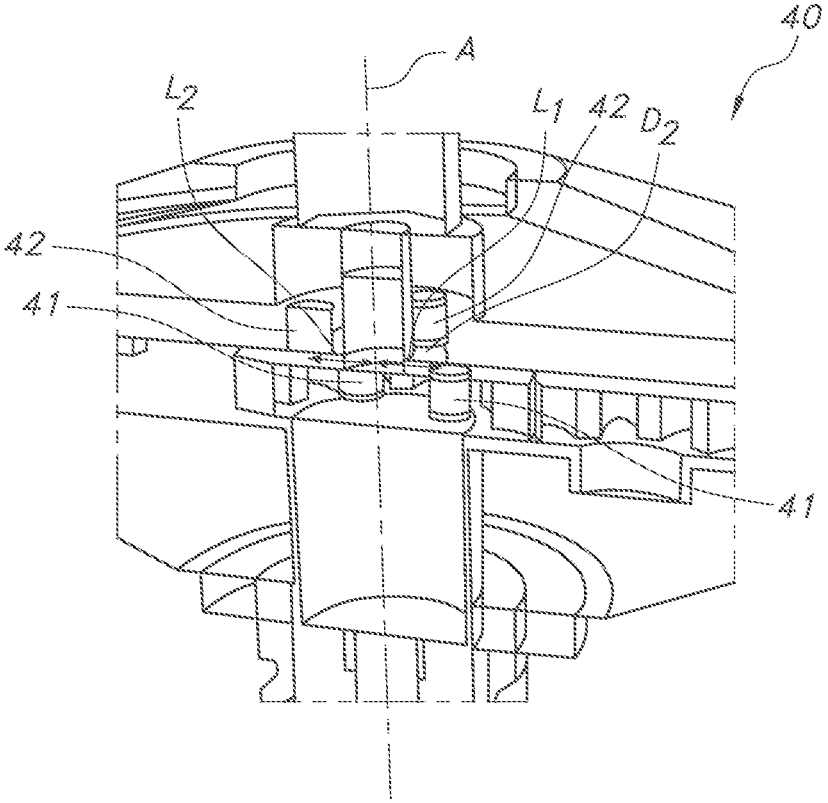

FIGS. 1 and 3 further depict an embodiment, wherein a total number of first permanent magnets 41 equals three. In addition, a total number of second permanent magnets 42 equal three. Especially, if the total number of first permanent magnets 41 is at least two, the total numbers of first permanent magnets 41 may be selected to equal the total number of second permanent magnets 42. Yet in further embodiments, these total numbers may differ from each other.

Figure 2:
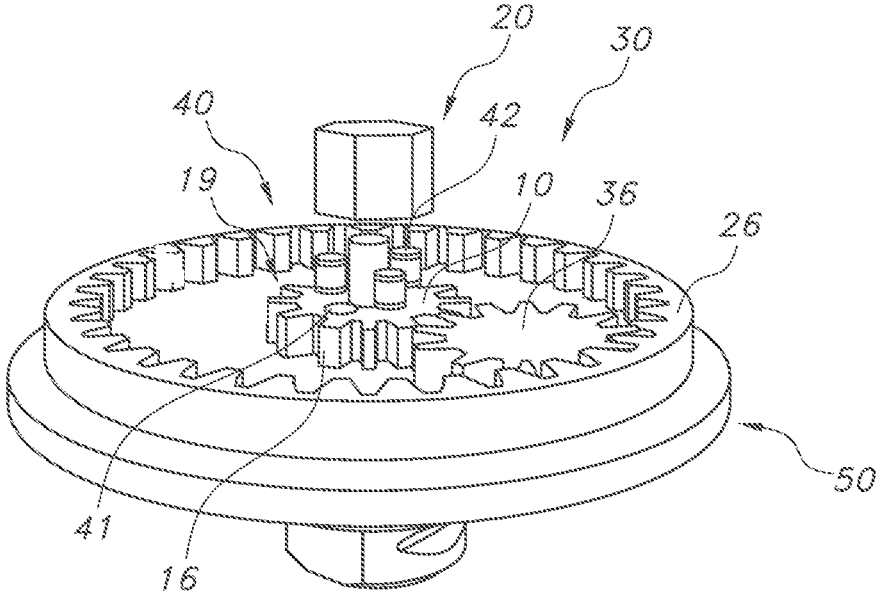
FIGS. 2-5 schematically depict some aspects of device according to the invention.

In the embodiments depicted in the FIGS., the rotational coupling mechanism 30 comprises a first gear 16 and a second gear 26 and a further gear 36. In FIG. 2, the rotational coupling mechanism 30 is depicted in more detail. In the figs, the receiving element 10 comprises the first gear 16 and the base 20 comprises the second gear 26, and the first gear 16 and the second gear 26 are rotationally coupled, especially via the further gear 36. Especially, the second gear 26 comprises an internal gear. The first gear 16, and also the optional further gears 36 may comprise external gears. The rotational coupling mechanism 30 is especially configured to provide a base rotation frequency to the base 20 based on a receiving element rotation frequency of the receiving element 10 during rotation of the receiving element 10. In further embodiments, no further gear 36 or more than one further gear 36 are comprised by the coupling mechanism 30.

In embodiments, the first gear 16, the second gear 26, and the optional one or more further gears 36 are configured to provide a ratio of the base rotation frequency to the receiving element 10 rotation frequency selected from the range of 0.2-5, during rotation of the receiving element 10.

Depending on the number of gears 16, 26, 36 (together providing a gear train) the rotational movement 35 of the base 20 may be in the same direction as the rotational movement of the receiving element. Yet, in other embodiments, the rotational coupling mechanism 30 is configured to provide the rotational movement 35 of the base 20 in a direction opposite to a rotational movement (direction) of the receiving element 10. Schematically this is depicted in FIG. 4 with the arrows at the first magnets 41 and at the second magnets 42.

Especially, based on the number of first permanent magnets 41 and second permanent magnets 42, and especially also by the base rotation frequency relative to the receiving element rotation frequency, the oscillation frequency may be set. In embodiments, the oscillation generator 40 is configured to provide a ratio of a frequency of the oscillation movement 45 to a rotation frequency of the receiving element 10 selected from the range of 5-50, during rotation of the receiving element 10. Additionally or alternatively, the oscillation generator 40 is configured to provide a ratio of a frequency of the oscillation movement 45 to a base rotation frequency selected from the range of 3-50, during rotation of the receiving element 10.

In the embodiment depicted in FIG. 1, the receiving element 10 comprises a protrusion 18 protruding at a first end 19 of the receiving element 10 in a direction of the axis of rotation A and a coupling element 12 arranged at a second end 11 of the receiving element 10. The protrusion 18 is configured rotationally symmetric around the axis of rotation A. The coupling element 12 is configured to functionally couple to the rotational driving element 1001 of the apparatus 1000. The base 20 further comprises a first base end 29 and a second base end 21, wherein the first base end 29 is configured to connect to the skin treatment element 200, and the second base end 21 comprises a second base end opening 23 configured rotationally symmetric around the axis of rotation A and encompassing the protrusion 18. This way the base 20 may rotate and oscillate relative to the remainder of the device 1. To allow these movements 35, 45, the second base end opening 23 may be configured to allow the base 20 to rotate about the protrusion 18 and to oscillate parallel to the axis of rotation A relative to receiving element 10.

The device 1, especially comprising the skin treatment element 200 functionally coupled to the device 1, may be configured for treating a skin, such as cleansing a skin. In embodiments, the device 1 of the invention is configured for cleansing a skin. Especially, such (cleansing) embodiment of the device 1 comprises the skin treatment element 200 connected to the base 20, and is configured for rotating the skin treatment element 200, especially at a skin treatment element rotation frequency, relative to the connector element 58 and for simultaneously oscillation of the skin treatment element 200, especially at a skin treatment oscillation frequency, relative to the connector element 58, (during rotation of the receiving element 10). Also in such embodiment, the skin treatment rotation frequency and the oscillating frequency of the skin treatment element 200 are especially based on the rotation frequency of the receiving element 10. Especially, the skin treatment rotation frequency and the base rotation frequency are equal. Also, the oscillation frequency of the skin treatment head may equal the oscillation frequency of the base. An embodiment of the device 1 may especially be configured to provide a ratio of the oscillation frequency to the rotation frequency of the receiving element 10 equal to or larger than 12. The oscillation movement 45 may be defined by a movement in a first direction (away from the connector element 58) and a movement in the second opposite direction. Especially, repelling first and second permanent magnets 41, 42 may cause the movement in the first direction. The movement in the second direction may be provided by pressing the treatment element 200 to a skin. The embodiment given in FIG. 1 comprises resilient elements 47 to (also) force the base 20 in the direction of the connector element 58. In further embodiments, a number of first permanent magnets 41 and second permanent magnets 42 may be arranged to attract each other during rotation of the receiving element 10.

The invention may especially comprise the use of an arrangement of magnets 41, 42 in a counter-rotating setting to create a force-actuation for the axial motion, i.e. the oscillation movement 45. Especially, the axial movement 45 may be created without introducing friction, wear or excessive acoustic noise.

When using sets of opposing or attracting magnets 41, 42, there is a repelling or attracting force as these are translated relative to each other. The increase of this force over the travel may be gradual, without any shocks or discontinuities, see FIG. 5 showing a changing force F as a function of a distance between the first permanent magnet 41 and the second permanent magnet 42, (when the magnets 41, 42 move relatively towards and away from each other during rotation of the receiving element 10).

When there is no load on the axial motion, especially no external pressure force acting via the base 20 in a direction of the connector element 58, there is no net loss of energy from this axial force F provided by the magnets 41, 42. The increase in (rotary) load during a ramp-up of the axial force F is offset by an equal decreasing of (rotary) load during the ramp-down. The inertia and momentum of the entire drive train of the appliance and accessory 200 may dampen this variation in (rotary) load. Hence, the load may have no significant impact on the rotating speed of the assembly.

When an axial load is applied, this load may have an effect of an increased rotary net-load on the receiving element 10. The arrangement has a high efficiency, having no inherent losses other than for the intended function.

For a cleansing function, the oscillation frequency preferably is at a higher frequency than the rotation frequency of the treatment head 200 (or the base 20). Using a plurality of first and/or second permanent magnets 41, 42 over the diameter of the device 1 may increase the oscillation frequency. This opens the possibility to multiply the oscillation frequency by a factor of 2 to 4, or even more, without incurring prohibitive cost or requiring too large a space envelope. However, arranging the first and second permanent magnets 41, 42 respectively on two counter-rotating planes D1, D2, may increase the oscillation frequency further, see e.g. FIG. 4, wherein the curved arrows indicate a direction of rotation of the first permanent magnets 41 and the second permanent magnets 42 respectively.

With e.g. a receiving element rotation frequency of the receiving element 10 of 3000 rpm, a 3 to 1 gearing down (provided by the rotational coupling mechanism 30) may provide a base rotation frequency of the base 20 (and eventually of the treatment element 200) at 1000 rpm (the opposite direction). Then the first permanent magnet(s) 41 and the second permanent magnets(s) 42 may comprise a mutual rotation frequency relative to each other of 4000 rpm. With three first permanent magnets 41 and three second permanent magnets 42 over the circumference, the oscillation frequency may then be equal to 12000 rpm. Thus, the ratio of the oscillation frequency to the receiving element frequency may in such embodiment be 12.

It is noted that the described embodiment having a 3 to 1 gearing down ratio is a simplified example. In further embodiments, a reduction of 9 to 1 is provided. This could be done by changing the ratios of the mechanism of the gears 16, 26, 36 or by adding extra further gears 36. With increased overall gear ratio, the frequency increase effect is even larger than in the pictured embodiment. Furthermore, a modified or completely different rotational coupling mechanism 30 may be used to improve the running properties of the base 20 with respect to the receiving element 10.

The compact arrangement with the opposing sets of magnets 41, 42 close to the axis of rotation A, as is depicted in the FIGS., allows for an actuation at the point the motion is required. This may reduce the need for stiffness and tight tolerances in the build-up (configuration) of the device 1 and/or or accessory.

To enable the oscillation motion 45, in embodiments, the force can be alternatingly applied in one direction, relying on a resilient element 47, such as a spring operating on the arrangement to provide the return motion. A resilient element 47 may be configured to force the base 20 in a direction of the connector element 58. The resilient element 47 may e.g. be arranged between the housing 50 and the base 20 and configured to resiliently translate the base 20 in a direction to the first inner wall 51, see FIG. 1.

In further embodiments the first and second permanent magnets 41, 42 are configured to provide periodically a mutually alternating attracting and repulsion force during rotation of the receiving element 10. Hence, in embodiments the device 1 comprises opposing sets of magnets 41, 42 to generate alternating axial forces from the magnet-sets 41, 42.

The invention further provides a kit of parts, comprising a device 1 and one or more skin treatment elements 200 functionally connectable to (the base 20 of) the device 1. Alternatively or additionally, a kit of parts may comprise the device 1 and a shaver 1010.

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The invention claimed is:

1. A device removably connectable to an apparatus with a rotational driving element, the device comprising:

a connector element configured to be detachably attached to the apparatus;

a receiving element configured to functionally couple to the rotational driving element, enabling the receiving element to rotate around an axis of rotation in response to mechanical energy transferred from the apparatus;

a base configured to connect to a skin treatment element, a rotational coupling mechanism configured to rotationally couple the base with the receiving element; and an oscillation generator comprising a first permanent magnet and a second permanent magnet, and configured to introduce an oscillation movement to the base in an axial direction, parallel to the axis of rotation during rotation of the base with a base rotation frequency, based on a periodical repulsion or attraction of the first permanent magnet and the second permanent induced by rotation of the receiving element, wherein the first permanent magnet is arranged at a first circular plane and the second permanent magnet is arranged at a second circular plane offset from the first circular plane in the axial direction, such that the first permanent magnet is entirely offset from the second permanent magnet in the axial direction.

2. The device according to claim 1, wherein the first permanent magnet is configured to repel the second permanent magnet when at a shortest mutual distance during, a rotation of the receiving element.

3. The device according to claim 1, wherein the receiving element comprises the first permanent magnet and wherein the base comprises the second permanent magnet.

4. The device according to claim 1, comprising a plurality of additional first permanent magnets arranged at the first circular plane and a plurality of additional second permanent magnets arranged at the second circular plane, for providing an oscillation frequency of the base higher than the base rotation frequency during the rotation of the base.

5. The device according to claim 4, wherein the plurality of additional first permanent magnets are arranged at first distance to the axis of rotation, and wherein the plurality of additional second permanent magnets are arranged at second distance to the axis of rotation, and wherein a ratio of the first distance to the second distance is selected from a range of 0.9-1.1.

6. The device according to claim 4, wherein a total number of the plurality of additional first permanent magnets equals a total number of the plurality of additional second permanent magnets.

7. The device according to claim 1, wherein the rotational coupling mechanism comprises a first gear and a second gear, wherein the receiving element comprises the first gear and wherein the base comprises the second gear, and wherein the first gear and the Second are rotationally coupled via one or more further gears, and wherein the rotational coupling mechanism is configured to provide the base rotation frequency to the base based on a receiving element rotation frequency of the receiving element during rotation of the receiving element.

8. The device according to claim 7, wherein the first gear, the second gear, and the one or more further gears are configured to provide a ratio of the base rotation frequency to the receiving element rotation frequency selected from a range of 0.2-5, during rotation of the receiving element.

9. The device according to claim 1, wherein the oscillation generator is configured to provide a ratio of a frequency of the oscillation movement to a base rotation frequency selected from a range of 3-50.

10. The device according, to claim 1, wherein the rotational coupling mechanism is configured to provide a rotational movement of the base in an opposite direction to a rotational movement of the receiving element.

11. The device according to claim 1, wherein the receiving element comprises a protrusion protruding at a first end of the receiving element in the axial direction and configured rotationally symmetric around the axis of rotation, a coupling element arranged at a second end of the receiving element and configured to functionally couple to the rotational driving element of the apparatus, wherein the base comprises a first base end configured to be connected to the skin treatment element, and a, second base end comprising a second base end opening configured rotationally symmetric around the axis of rotation and encompassing the protrusion, wherein the second base end opening is configured to allow the base to rotate about the protrusion and to oscillate parallel to the axis of rotation relative to receiving element.

12. The device according to claim 1, wherein the device comprises the skin treatment element connected to the base for cleansing skin.

13. The device according to claim 1, wherein the connector element is configured to provide a click-on fixation with the apparatus.

14. The device according to claim 1, wherein the first permanent magnet and the second permanent magnet are arranged at substantially the same distance from the axis of rotation in a direction perpendicular to the axial direction.

15. A kit of parts comprising, a device according claim 1, and one or more skin treatment elements functionally connectable to the base.

16. A kit of parts comprising a device according to claim 1 and a shaver comprising the rotational driving element, wherein the device is functionally connectable to the rotational driving element of the shaver.

17. A device removably connectable to an electric shaver with a rotational driving element, the device comprising:

a connector element detachably attached to the electric shaver;

a receiving element configured to functionally couple to the rotational driving element of the electric shaver enabling the receiving element to rotate around an axis of rotation in response to mechanical energy transferred from the electric shaver;

a base configured to connect to a skin treatment element;

a rotational coupling mechanism configured to rotationally couple the base with the receiving element; and an oscillation generator comprising a plurality of first permanent magnets arranged at a first circular plane and a plurality of second permanent magnets arranged at a second circular plane, wherein the oscillation generator is configured to introduce an oscillation movement to the base in an axial direction, parallel to the axis of rotation during rotation of the base with a base rotation frequency, based on a periodical repulsion or attraction of the plurality of first permanent magnets and the plurality of second permanent magnets, induced by rotation of the receiving element, and wherein the second circular plane is offset from the first circular plane in the axial direction, such that all of the plurality of first permanent magnets are entirely offset from all of the plurality of second permanent magnets in the axial direction.

18. The device a claim 17, wherein each of the plurality of first permanent magnets is arranged at the first circular plane at substantially the same distance from the axis of rotation as each of the plurality of second permanent magnets at the second circular plane.

19. The device according to claim 17, wherein the receiving element comprises the plurality of first permanent magnets and the base comprises the plurality of second permanent magnets.

20. The device according to claim 17, wherein the rotational coupling mechanism is configured to provide a rotational movement of the base in an opposite direction to a rotational movement of the receiving element.

* * * * *